United States Patent [19]

Liu

[11] Patent Number: 4,722,828

[45] Date of Patent: Feb. 2, 1988

[54] HIGH-TEMPERATURE FABRICABLE NICKEL-IRON ALUMINIDES

[75] Inventor: Chain T. Liu, Oak Ridge, Tenn.

[73] Assignee: Martin Marietta Energy Systems, Inc., Oak Ridge, Tenn.

[21] Appl. No.: 730,602

[22] Filed: May 6, 1985

Related U.S. Application Data

[63] Continuation-in-part of Ser. No. 519,941, Aug. 3, 1983.

[51] Int. Cl.[4] ..... C22C 19/03

[52] U.S. Cl. ..... 420/455

[58] Field of Search ..... 420/443, 455, 459, 460; 148/429

[56] References Cited

PUBLICATIONS

Researchers Improve the Ductility of Nickel Aluminides, Iron Age, Sep. 24, 1982.

*Primary Examiner*—R. Dean

[57] ABSTRACT

Nickel-iron aluminides are described that are based on $Ni_3Al$, and have significant iron content, to which additions of hafnium, boron, carbon and cerium are made resulting in $Ni_3Al$ base alloys that can be fabricated at higher temperatures than similar alloys previously developed. Further addition of molybdenum improves oxidation and cracking resistance. These alloys possess the advantages of ductility, hot fabricability, strength, and oxidation resistance.

9 Claims, No Drawings

HIGH-TEMPERATURE FABRICABLE NICKEL-IRON ALUMINIDES

It is a result of work under a contract with the United States Department of Energy.

This is a continuation-in-part of a previously filed co-pending application Ser. No. 519,941(79) filed Aug. 3, 1983 that is hereby incorporated by reference.

BACKGROUND OF THE INVENTION

This invention relates to high strength nickel-iron aluminide alloys that exhibit desirable hot ductility and fabricability.

Ordered intermetallic alloys based on tri-nickel aluminide ($Ni_3Al$) have unique properties that make them attractive for structural applications at elevated temperatures. They exhibit the unusual mechanical behavior of increasing yield stress with increasing temperature whereas in conventional alloys yield stress decreases with temperature. Tri-nickel aluminide is the most important strengthening constituent of commercial nickel-base superalloys and is responsible for their high-temperature strength and creep resistance. The major limitation of the use of such nickel aluminides as engineering materials has been their tendency to exhibit brittle fracture and low ductility.

Recently alloys of this type have been improved by the additions of iron to increase yield strength, boron to increase ductility, and titanium, manganese and niobium for improving cold fabricability (Commonly assigned and co-pending U.S. patent application Ser. No. 519,941 filed Aug. 3, 1983, Ductile Aluminide Alloys for High Temperature Applications, Liu and Koch). Another improvement has been made to the base $Ni_3Al$ alloy by adding iron and boron for the aforementioned purposes and, in addition, hafnium and zirconium for increased strength at higher temperatures (Commonly assigned and co-pending U.S. patent application Ser. No. 564,108 filed Dec. 21, 1983, U.S. Pat. No. 4,612,165, Ductile Aluminide Alloys for High Temperature Applications, Liu and Steigler). These co-pending U.S. patent applications are incorporated herein by reference.

Although these improved alloys have many beneficial characteristics, they still exhibit some shortcomings which detract from their usefulness. For example, the previous nickel aluminide alloys suffer a decrease in ductility and workability with increasing temperature. Any fabrication of the alloys into structures of desired configurations by rolling or forging must be achieved at temperatures less than 700° C. Such alloys would be of greater value if the hot fabricability could be achieved at a higher temperature of up to about 1,200° C. since industry fabrication experience and capability exist at this temperature. Other benefits derived from fabrication at higher temperatures include reduction in the fabrication cost and the elimination of the need for high-power fabrication equipment.

SUMMARY OF THE INVENTION

Therefore, to address the above-mentioned problem it is an object of this invention to provide a nickel-iron aluminide alloy that is fabricable by hot rolling or forging at temperatures of about 1,200° C.

Another object is to provide a high-temperature fabricable nickel-iron aluminide alloy that possesses high yield strength, good ductility and resistance to oxidation at elevated temperatures.

A further object of this invention is to provide a nickel-iron aluminide alloy having the above-mentioned characteristics that can be manufactured at relatively low cost using existing manufacturing techniques.

Additional objects, advantages and novel features of the invention will be set forth in part in the description which follows, and in part will become apparent to those skilled in the art upon examination of the following or may be learned by practice of the present invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the alloys of this invention may comprise compositions based on the $Ni_3Al$ alloy but having additions of other elements and variations in proportions as necessary to achieve the desired objectives. Additional elements include iron, boron, one or more of the Group IVb elements of the Periodic Table to increase high-temperature strength and one or more rare earth elements to improve hot fabricability. Also, additions of molybdenum and carbon are utilized to respectively improve resistance to oxidation and cracking. Iron is present in an amount from 14 to 17 weight percent, a sufficient concentration of boron is present to enhance ductility, the combined concentration of the Group IVb elements are present in an amount less than 1 weight percent, and the rare earth elements are added in trace quantities of sufficient concentrations to increase hot fabricability to temperatures greater than about 700° C. Molybdenum is added to the alloy composition in an amount adequate to reduce oxidation. Carbon is utilized in sufficient quantities to repress hot cracking resulting from the addition of molybdenum. The remainder or balance of the alloy is formed of the base $Ni_3Al$ composition.

More specifically, in the preferred embodiment the amount of boron sufficient to enhance ductility is from .01 and .03 weight percent. The preferred Group IVb element is hafnium although zirconium, based on limited results, functions similarly. The preferred rare earth element is cerium and the amount sufficient to increase hot fabricability to a temperature of about 1,200° C. is in the range of about 0.002 to .007 weight percent with the preferred amount being about 0.005 weight percent. It is believed that yttrium, thorium, and lanthanum would function similarly to cerium.

Also the amount of molybdenum needed to improve oxidation resistance is up to about 4 weight percent with up to about 0.1 weight percent carbon to suppress cracking during hot fabrication.

The nickel-iron aluminides of this invention have the advantage of possessing the combined properties of ductility, hot fabricability, high tensile strength up to about 600° C., and oxidation resistance. In addition, these aluminides are of low density and low cost compared with commercially available nickel-based superalloys.

Detailed Description of the Preferred Embodiment

The alloy ingots of this invention are prepared by arc melting of correct proportions of pure metal chips and Ni-4 weight percent B and Ni-4 weight percent Ce master alloys. The master alloys were used for precise control of Be and Ce concentrations in the alloys. The alloy ingots were fabricated by hot rolling at 1,200° C.

with three passes at a 12% reduction per pass. The ductility and the hot fabricability of these nickel-iron aluminides are sensitive to the iron concentration, the iron to nickel ratio, and additions of rare earth elements such as cerium to the alloy composition.

Table I presents a series of nickel-iron aluminides based on an alloy designated IC-47 having the composition 10.4 weight percent aluminum, 16.1 weight percent iron, 0.05 weight percent boron and the balance nickel. This alloy is modified with Hf (or Zr) and other alloys additions as indicated in the Table I with these modified alloys possessing different "IC" numbers.

TABLE I

| | Composition,[a] weight percent | Hot fabricability[b] |
|---|---|---|
| IC-47 | Ni—10.4 Al—16.1 Fe—0.05 B | Numerous surface cracks |
| IC-105 | Ni—10.0 Al—15.9 Fe—1.7 Hf—0.02 B | Numerous surface and edge cracks |
| IC-124 | Ni—10.2 Al—16.0 Fe—0.9 Hf—0.02 B | Some surface cracks, no edge cracks |
| IC-126 | Ni—10.2 Al—16.0 Fe—0.9 Hf—0.02 B—0.005 Ce | Two surface cracks, no edge cracks |
| IC-159 | Ni—10.2 Al—16.6 Fe—0.9 Hf—0.015 B—0.005 Ce | No cracks |
| IC-165 | Ni—10.2 Al—16.6 Fe—0.4 Zr—0.015 B—0.005 Ce—0.03 C | No cracks[c] |
| IC-166 | Ni—10.2 Al—16.3 Fe—0.9 Ze—0.015 B—0.005 Ce—0.03 C | Some surface cracks |

[a]All alloys contain 0.25 to 0.5 at. % Hf or Zr.
[b]Hot-rolled at 1,200° C. with 3 passes, 12% reduction per pass.
[c]No cracks during hot rolling at 1,100° C. but minor surface cracks during hot rolling at 1,200° C.

Hafnium or zirconium is added to improve the high-temperature strength of the alloy. However, the addition of hafnium and zirconium to the alloy composition must be limited to less than 1 weight percent (or 0.5 at.%) since with greater concentrations of hafnium and zirconium the hot fabricability of the alloy is impaired. Surprisingly, a small amount of cerium (0.002 to 0.007 weight percent) substantiallly improves hot fabricability of nickel-iron aluminides. The alloy designated IC-159 containing .005 weight percent cerium and 16.6 weight percent iron had the best hot fabricability with no evidence of cracks during hot rolling at 1,200° C.

Another series of nickel-iron aluminides based on the IC-47 alloy was prepared and further modified with the additions of hafnium, cerium, molybdenum and carbon as shown in Table II. Again, the modified alloys are provided with different "IC" numbers.

TABLE II

| | Composition, weight percent | Hot fabricability* |
|---|---|---|
| IC-47 | Ni—10.4 Al—16.1 Fe—0.05 B | Numerous surface cracks |
| IC-109 | Ni—9.8 Al—13.8 Fe—1.7 Hf—3.7 Mo—0.025 B | Numerous surface and edge cracks |
| IC-117 | Ni—10.0 Al—13.9 Fe—0.9 Hf—3.7 Mo—0.025 B | Numerous surface cracks, no edge cracks |
| IC-123 | Ni—10.0 Al—15.8 Fe—0.9 Hf—3.7 Mo—0.02 B | Some surface cracks, no edge cracks |
| IC-152 | Ni—10.0 Al—15.8 Fe—0.9 Hf—3.7 Mo—0.015 B—0.005 Ce—0.06 C | No cracks |
| IC-157 | Ni—10.0 Al—15.8 Fe—0.9 Hf—3.7 Mo—0.015 B—0.005 Ce | Three surface cracks, no edge cracks |
| IC-158 | Ni—10.1 Al—16.4 Fe—0.9 Hf—2.7 Mo—0.015 B—0.005 Ce | One minor surface cracks, no edge cracks |

*Hot-rolled at 1,200° C. with 3 passes, 12% reduction per pass.

Molybdenum was added to the alloy composition to improve oxidation resistance. With a molybdenum concentration at 3.7 weight percent the hot fabricability of the nickel-iron aluminides was strongly dependent on a small change in alloy composition. With iron concentration less than about 14.5 weight percent, considerable cracking occurred during hot fabricability. A combination of 0.005 weight percent cerium and 0.06 weight percent carbon together with iron at 15.8 weight percent completely suppressed the crack formation resulting in a preferred alloy having the composition as designated by IC-152. The iron content in the alloys is limited to less than 17.5%; otherwise the alloys may lose some of their high-temperature strength.

These are examples of two nickel-iron aluminide alloys that can be readily fabricated by hot rolling or forging at 1,200° C. By comparison commercially available nickel aluminides cannot be hot fabricated by hot rolling or forging at temperatures above 700° C.

Upon metallographic examination of the two prepared alloys, a significant amount (20-30% by volume) of a second phase, probably B2 (ordered bcc phase similar to FeAl), was detected after water quenching from 1,200° C. The volume fraction of the B2 phase decreases with the decrease in annealing temperature, showing less than about 2% B2 phase after annealing for sixteen hours at 800° C. Comparison of the microstructure of the alloys further indicates that alloying with molybdenum additions reduces the formation of the disordered phase in nickel-iron aluminides.

The tensile properties of the nickel-iron aluminides set forth in Tables I and 11 were determined at temperatures to 1,200° C. on sheet specimens with a gage section of 12.7 mm×0.8 mm at a crosshead speed of 25 mm/min. in vacuum. The tensile properties of alloys designated IC-152 and IC-159 were compared with tensile properties done on a nickel aluminide having the composition of 11.9 weight percent aluminum, 1.7 weight percent hafnium, .015 weight percent boron and the balance nickel and designated IC-136. These comparisons at various temperatures are shown in Table III.

TABLE III

| Alloy Number | Yield Stress (ksi) | Tensile Strength (ksi) | Elongation (%) |
|---|---|---|---|
| | Room Temperature | | |
| IC-136 | 52.0 | 195.3 | 38.1 |
| IC-159 | 77.4 | 195.0 | 40.3 |
| IC-152 | 97.5 | 222.0 | 29.0 |
| | 600° C. | | |
| IC-136 | 92.6 | 158.8 | 50.6 |
| IC-159 | 94.9 | 140.0 | 47.9 |
| IC-152 | 112.0 | 150.0 | 26.8 |
| | 850° C. | | |
| IC-136 | 86.2 | 111.9 | 18.6 |
| IC-159 | 68.0 | 72.2 | 29.8 |
| IC-152 | 78.1 | 84.2 | 26.4 |
| | 1,000° C. | | |
| IC-136 | 46.2 | 52.2 | 16.2 |
| IC-159 | 26.6 | 28.6 | 40.6 |
| IC-152 | 27.1 | 33.9 | 48.1 |
| | 1,200° C. | | |
| IC-136 | 21.2 | 22.3 | 25.0 |
| IC-159 | 2.5 | 2.8 | 152.5 |
| IC-152 | 2.2 | 2.2 | 199.5 |

As shown in Table III the yield strengths of the nickel-iron aluminides of the present invention are higher than those of the nickel aluminide (IC-136) at room temperature and 600° C. However, these nickel-iron aluminides show a substantial decrease in strength at temperatures above about 600° C. and actually become weaker than the nickel aluminide at temperatures above 850° C. However, and significantly, the nickel-iron aluminides of the present invention are much more ductile than the nickel aluminide at 1,000° C. and 1,200° C. and both nickel-iron aluminide alloys exhibit superplastic behavior with tensile elongations exceeding 150% at 1,200° C. The high ductility of the nickel-iron aluminides is consistent with their excellent hot fabricability at 1,200° C.

The creep properties of the nickel-iron aluminide IC-159 has been determined at 760° C. and 138 and 276 MPa. Limited results set forth in Table IV below indicate that the creep rupture life of the nickel-iron aluminides is considerably shorter than nickel aluminides but slightly better than that of Hastelloy X, a trademarked alloy available from Cabott Corporation, Kokomo, Indiana.

TABLE IV

| Ni aluminides | Ni-Fe aluminide (IC-159) | Hastelloy-X[b] | Waspalloy[c] |
|---|---|---|---|
| >2,000 | 760° C., 138 MPa<br>300 | 200 | |
| 300 to >800[a] | 760° C., 276 MPa<br>12 | | 1,000 |

[a]The range depends on the HF content in the alloys.
[b]Commercially fabricable Ni-base alloy with composition Ni-21.8 Cr-2.5 Co-9.0 Mo-0.6 W-18.5 Fe, weight percent
[c]Commercial Ni-base alloy with limited fabricability Ni-19.5 Cr-13.5 Co-4.3 Mo-3.0 Ti-1.4 Al-2.0 Fe-.0006 B-0.07 Zr-0.07 C, weight percent Coupons of nickel-iron aluminides were recrystallized in a furnace for one hour at 1,050° C. and then exposed to air to determine oxidation resistance. The coupons were periodically (every one to three days) removed from the furnace for visual examinations and weight measurements. The coupons exhibited consistent weight gain during cyclic oxidation at 800° C. and 1,000° C. The oxidation rates of nickel-iron aluminides containing molybdenum were comparable at 800° C. and 1,000° C. whereas oxidation rates of the nickel-iron aluminides containing no molybdenum were lower at 1,000° C. than at 800° C. This lower rate suggests that aluminum atoms diffuse rapidly from the interior to the surface at 1,000° C. to an aluminum oxide film on the surface which protects the base metal from further oxidation. The nickel-iron aluminides showed oxidation resistance that was comparable to nickel aluminides at 1,000° C.

It will be seen that the nickel-iron aluminides of the present invention possess the combined benefits of ductility, hot fabricability, strength, and oxidation resistance. In addition, they have the advantage of low density and low cost when compared with commercial nickel-base superalloys. The density of the aluminides is lower than that of Ni-base superalloy by 10-15%. A critical factor that distinguishes this invention over previous work is an increase in iron concentration accompanied by the presence of hafnium and boron. The addition of small amounts of other elements such as cerium, molybdenum and carbon result in an alloy with greatly improved fabricability properties at high temperatures.

The foregoing description of preferred embodiments of the invention has been presented for purposes of illustration and description and is not intended to be exhaustive or to limit the invention to the precise forms disclosed. Obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A nickel-iron aluminide consisting essentially of:

a $Ni_3Al$ base;

a sufficient concentration of a Group IVb element or mixtures thereof to increase high temperature strength;

a sufficient concentration of material selected from the group consisting of iron and a rare earth element or mixtures thereof to increase hot fabricability; and a sufficient concentration of boron to increase ductility.

2. The nickel-iron aluminide of claim 1 wherein said concentration of iron is in the range of 14.5 to 17.5 weight percent.

3. The nickel-iron aluminide of claim 2 having a sufficient amount of molybdenum to effect a reduction in oxidation of said nickeliron aluminide and a sufficient amount of carbon to reduce cracking due to the addition of molybdenum.

4. The nickel-iron aluminide of claim 2 wherein said Group IVb element is selected from the group consisting of hafnium, zirconium and mixtures thereof and present in the amount of less than 1 weight percent.

5. The nickel-iron aluminide of claim 2 wherein said rare earth element is cerium present in the amount of from no more than 0.01 weight percent.

6. The nickel-iron aluminide of claim 2 wherein boron is present in an amount from 0.01 to 0.05 weight percent.

7. The nickel-iron aluminide of claim 2 having the composition of 10.2 weight percent aluminum, 16.6 weight percent iron, 0.9 weight percent hafnium, 0.015 weight percent boron, 0.005 weight percent cerium and the balance nickel.

8. The nickel-iron aluminide of claim 3 wherein said molybdenum is present in an amount of not more than 4 weight percent and said carbon is present in not more than 0.01 weight percent.

9. The nickel-iron aluminide of claim 3 having the composition 10.0 weight percent aluminum, 15.8 weight percent iron, 0.9 weight percent hafnium, 3.7 weight percent molybdenum, 0.015 weight percent boron, 0.005 weight percent cerium, 0.06 weight percent carbon and the balance nickel.

* * * * *